US005765379A

United States Patent [19]

Jensen

[11] Patent Number: 5,765,379

[45] Date of Patent: Jun. 16, 1998

[54] THERMAL INSULATION SYSTEM OF THE VACUUM TYPE

[75] Inventor: Torben Hove Jensen, Højbjerg, Denmark

[73] Assignee: Elcold-Tectrade I/S, Hobro, Denmark

[21] Appl. No.: 676,220

[22] PCT Filed: Jan. 19, 1995

[86] PCT No.: PCT/DK95/00028

§ 371 Date: Jul. 19, 1996

§ 102(e) Date: Jul. 19, 1996

[87] PCT Pub. No.: WO95/20136

PCT Pub. Date: Jul. 27, 1995

[30] Foreign Application Priority Data

Jan. 19, 1994 [DK] Denmark ..... 0081/94

[51] Int. Cl.[6] ..... F17C 1/00

[52] U.S. Cl. ..... 62/45.1; 312/401; 312/406

[58] Field of Search ..... 312/400, 401, 312/406; 62/50.7, 45.1

[56] References Cited

U.S. PATENT DOCUMENTS

| | | | |
|---|---|---|---|
| 2,969,092 | 1/1961 | Johnston | 62/50.7 |
| 3,130,561 | 4/1964 | Hnilicka, Jr. | 62/45.1 |
| 3,139,206 | 6/1964 | Matsch | 62/45.1 |
| 3,930,375 | 1/1976 | Hofmann | 62/45.1 |
| 3,942,331 | 3/1976 | Newman, Jr. et al. | 62/45.1 |
| 4,606,196 | 8/1986 | Acharya et al. | 62/50.7 |
| 5,408,832 | 4/1995 | Boffito et al. | 62/45.1 |
| 5,473,901 | 12/1995 | Roseen | 62/45.1 |

*Primary Examiner*—Ronald C. Capossela
*Attorney, Agent, or Firm*—Sixbey, Friedman, Leedom & Ferguson; David S. Safran

[57] ABSTRACT

It is already known that heat insulating elements, e.g. in refrigerators, may be more efficient if they are sealingly encapsulated and subjected to a high vacuum. Based on theoretical considerations in connection with foam having small cells it has been relevant to use a vacuum of the magnitude of 0.001 mbar and hermetical sealing of the elements. According to the invention it has been found that practically well usable results are achievable at much higher pressures, viz. in a range about 1 mbar, which is much easier to produce. Consequently, a further simplification can be obtained by renouncing the hermetical sealing and relying on an only "almost tight" sealing, combined with the use of an operationally active vacuum pump provided in each apparatus unit. Such a pump can easily have a capacity sufficient to maintain the moderate vacuum in spite of inward leaking of air from outside and a possible internal gas generation; for the specific purpose an insulation foam of the open cell type has been found to be preferable.

9 Claims, 1 Drawing Sheet

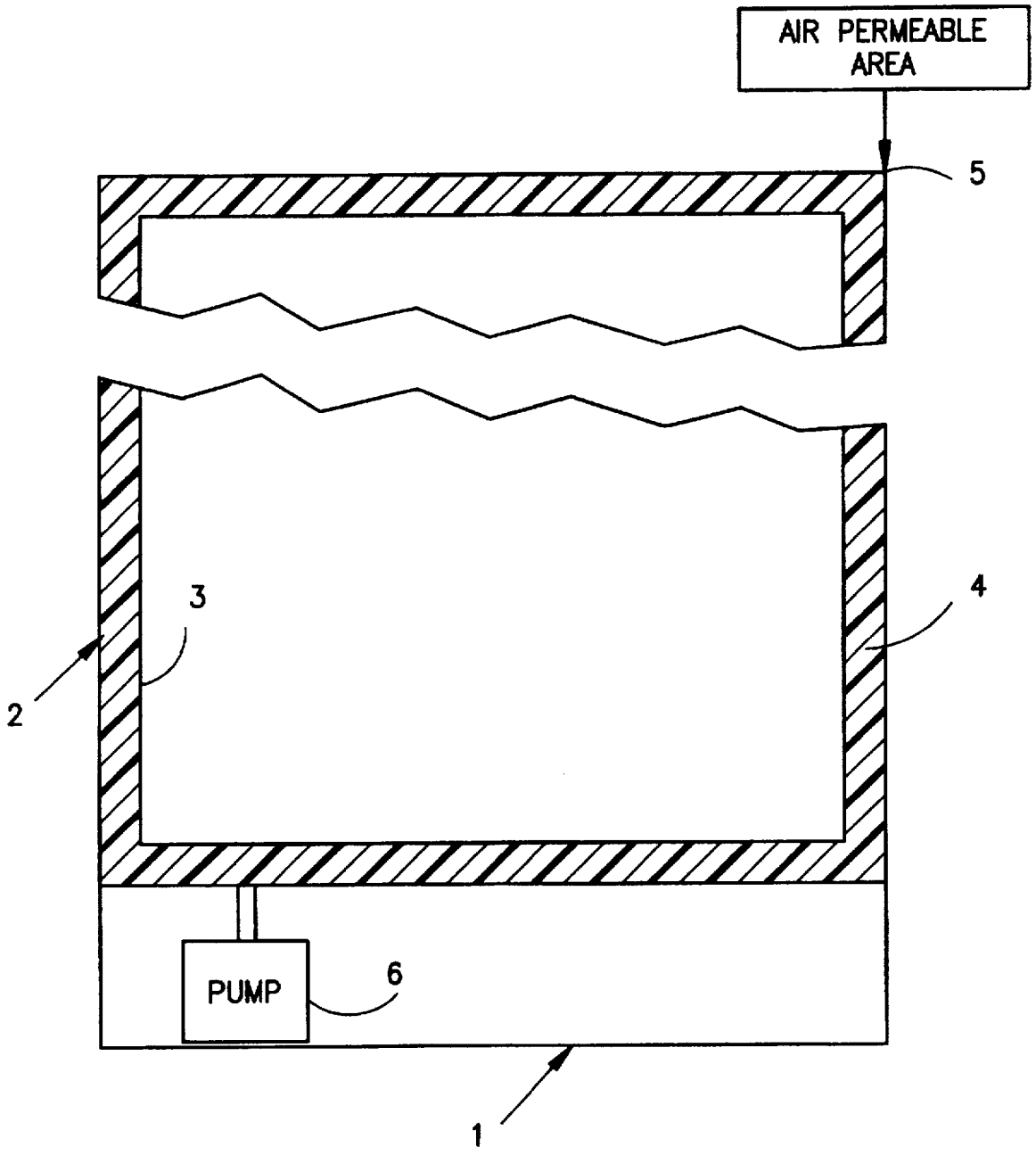
AIR PERMEABLE AREA
5
3
4
2
PUMP
6
1

THERMAL INSULATION SYSTEM OF THE VACUUM TYPE

BACKGROUND OF THE INVENTION

The present invention relates to thermally insulated units such as refrigerators, or to insulation elements such units. Conventionally, this type of units is made with an encapsulation made of a foam substance foamed with closed cells by the use of a blowing gas of a high molecular weight, whereby this gas by itself will be present in the closed cells and thus contribute to a high thermal insulation effect. As known, however, it has been found that there are some unlucky environmental effects of those gases, which are the best suited, and it has been found that acceptably applicable gases provide for a noticeably reduced insulation effect. It has already been proposed to go an entirely different way, viz. by evacuation of all gas in the insulation material, such that this may be present in a highly evacuated condition, whereby the insulation effect will be still better than with a heavy gas present in the material.

On this background it has been suggested to provide hermetically sealed, highly evacuated insulation panels, but these tend to be very expensive if they should be made such that their high insulation effect remains intact with the required duration. The hermetical sealing itself is expensive, and additionally it is required to use in the panels a fine cellular material, which is very expensive to produce when later development of gas in the material should be avoided; by the required very low pressure even a modest gas development will soon produce such a pressure rise that the super insulation gets lost.

DE-A-40 is 970 specifies the conditions for the establishing of the high insulation effect, given by a very low pressure and a small cell size in the insulation material. It is indicated that the high vacuum area in the pressure range below 0.001 mbar, but in the present connection this expression will also be used for pressures of about 1 mbar. Likewise it is indicated that it is hardly possible to produce insulation materials with a cell size below 1 mm, while by now it has been found that it is well possible to produce foam with cells of e.g. 0.1–0.5 mm. The results of the present invention seem to verify that there is not the best accordance between theory and practice with respect to the condition that the cell or pore size should be smaller than the moving distance of the relevant gas molecules at the actual pressure, inasfar as the invention has resulted in very attractive results for cell sizes of approximately 0.2 mm and pressures of about 1 mbar, i.e. a pressure much higher than the theoretically applicable pressure, corresponding to a much smaller pubpressure and thus to a vacuum far easier to establish.

FR 2,628,179 discloses a technique, which, on the detailed level, is less interesting, because it is based on the use of macro cavities and a relatively low vacuum of 50–100 mbar, this not conditioning any noticeably improved insulation effect, but which is nevertheless principally significant in suggesting that the insulation elements of a given unit such as a refrigerator may be connected to a vacuum pump mounted in the unit itself. It is mentioned that the insulation elements can hardly be sealed in any absolute sense, i.e. they are not presupposed to be sealed in any hermetical and diffusion tight manner; however, this is not required when it is possible to carry out an operational, current evacuation of the elements, this giving fundamentally changed and improved possibilities for the maintenance of the required low pressure throughout a long lifetime for the relevant units. The vacuum pump, which is now a machine part of the single unit, should have only a very small capacity, as in the long run it will only have to do away with air intruding from outside into the insulation elements.

Seen in the perspective of the invention such an arrangement will be advantageous also in that the operative evacuation of the gas in the insulation elements will apply even to the later developed gas in the foam held in the insulation elements.

It belongs to the theoretical basis of the super insulation that there should be no noticeable gas convection in the insulation material, which, in a natural manner, has pointed towards the use of insulation foam with closed cells, such as proposed in the priority older EP 0,587,546, which, however, still refers to hermetically closed insulation panels and to pressures of less than 0.1 bar. It is specified that the associated vacuum pump, which can now, according to the said FR 2,628,179, be mounted in connection with the single operative unit, may have a very low capacity and thus a low energy consumption, which is more than balanced by the associated improvement of the insulation effect.

However, in that connection it is a problem that it may take considerable time before a newly manufactured insulation element has attained the degree of vacuum required for the desired high insulation effect, just as it is problematic and expensive to use hermetically sealed elements.

BRIEF DESCRIPTION OF THE DRAWING

The sole FIGURE of the drawing is a schematic depiction of a thermally insulating unit in accordance with the present invention.

Detailed Description of the Preferred Embodiment

According to the present invention it has been realized that it is possible with marked advantages to make use of a foam with open cells in a system which is not fully hermetically closed, and as mentioned it has been found that highly usable results are obtainable at cell sizes of 0.1–0.5 mm and pressures about 1 mbar, though the invention is not correspondingly limited. Thus, a heat conductivity of about 15 mW/mK has been noted, corresponding to an insulation improvement of 100–300% compared to conventional insulation foam under ambient pressure.

The conventionally most ideal heat conductivity, typically, has & amounted to approximately 18 for newly made, CFC gas based foam, which, however, by ageing, will exhibit a noticeably reduced insulation effect as the heavy CFC gas is displaced by air. Thus, it is very common that the insulation in aged refrigerators or freezers exhibits a heat conductivity of no less than 35 mW/mK. When the insulation is based on an evacuated system the meaning of using CFC gas vanishes, and it i n possible to operate with fully harmless foaming games such as in case of the so-called water-blown foams, where the blowing agent is carbon dioxide. The heat conductivity in the fresh blown foam amounts to about 25, but this figure will rise to about 35 as the carbon dioxide is displaced by air, which happens rather rapidly. A heat conductivity of about 15 in a system according to the invention, thus, will still be indicative of a very good result that will enable an advantageous combination of either a relatively thin or a highly efficient, thicker insulation layer and an associated vacuum pump, which may be adapted to produce a partial vacuum of the magnitude of only 1 mbar. For the invention, the relevant pressure range will be 0.1–25 mbar, though without sharp limits.

The circumstances here considered are not directly dependent of the foam cells being closed or open, but nevertheless, this is important in more respects A decisive factor is that the open celled foam can relatively rapidly be pumped out to assume a generally law pressure everywhere in the material, such that the high insulation effect is achievable rapidly after the operational start of the unit in question.

Another noticeable advantage is that there will be no requirements as to any really hermetical or diffusion tight encapsulation of the insulation material, inasfar as a vacuum pump that shall reduce the pressure to only some 1 mbar will relatively simple in practice, even though it should exhibit a sufficient capacity to also be able to exhaust gas originating from a limited air intrusion from outside. For the invention it will be of major importance that it is possible to produce refrigerators etc. in substantially the same manner as hitherto, viz. by direct casting or foaming up of the insulation foam in the formwork cavities formed between the outer and inner walls of the units. Some joints will be unavoidable, and these, of course, should be worked out very tightly, but yet without any hermetically sealed character. For comparison it should be mentioned that an occurring leakage in connection with a closed celled system will give rise to a noticeable pressure increase at the relevant place, whereby there is formed, locally, an area of expressed weakened insulation effect. This is avoided when the foam is open celled.

An encapsulation which is not hermetically sealed will also present the advantage that there is established a feeble intrusion of air, which may serve to wash out heavier gases developed in the foam. Even though the cells are predominantly open, such heavier molecules may be difficult to suck out, if they are not subjected to a certain transportation flow; however, once such a flow may occur, the foam may in return be produced without special precautions for avoiding afterdeveloped gases.

On the same background it has been found that the achievement of the high insulation effect after start of the pump can be promoted by providing for a controlled leak enabling the intake of scavenging air at a place opposite the pumping place or area. This circumstance can be so highly valued that it may be relevant to provide the units with a leak opening that is openable and closable in a programmed manner, e.g. just a few times a day during the first days and then, optionally, with considerably longer intervals.

Correspondingly, on the said background it may be advantageous to arrange the exhaust at an area as remote as possible from a potential leaking area such as a joint, while otherwise it could be considered resonable to establish the exhaust close to the leak. The exhaust, how ever, may also take place over one or more wide areas, e.g. through surface layers of a extra porous material, including fibrous or finely granular materials, which, themselves, may be usable as highly insulating materials at the low pressure.

In the figure, a thermally insulating unit 1 in accordance with the present invention is schmaticaUy represented as having a cabinet 2, such as that of a refrigerator, having hollow walls 3 defining an evacuatable space within which a core of cellular material 4 is disposed. The cabinet 2, as noted above, is constructed to permit a limited rate of air leakage into the evacuatable space in any of the above-mentioned manners, all of which are generically represented in the drawing by the labeled air permeable area 5, e.g., the construction of the cabinet 2 which permits the limited rate of air leakage may be an air permeable portion of the cabinet wall in air permeable area 5 produced by a controllably openable and closable leak producing means or by either an air permeable cabinet joint or an air permeable surface layer.

A vacuum pump 6 communicates with the cellular material 4 in the evacuatable space and has a pumping capacity which is coordinated to the limited rate of air leakage occurring at the air permeable area 5 in a manner enabling the pump 6 to maintain a pressure of a magnitude of 0.1–25 mbar within said evacuatable space which, as noted above, has been found to be an advantageous partial pressure for purposes of the present invention.

It should be anticipated that a foam for the present purpose will appear less knockproof in evacuated condition than with gas filled cells, as a gas or air filling will provide for a certain cushion effect. Since the insulation foam normally participates as a construction material, e.g. supporting for the bottom plate in a freezer unit, it may, therefore, be desirable to use a stronger from in the evacuated systems, i.e. a foam of higher density than usual, e.g. some 50 g/l instead of 35–40 g/l. In Systems with closed cells this would imply that it would be still more difficult and time consuming to achieve the low pressure in the cells, while with open cells this effect is hardly noticeable. Thus s it is perfectly possible to stick to the usual construction principles, where foam material with low density is used also as a statically supporting construction material. In this connection it should be mentioned that blown-up foam materials with open cells cannot help having a certain content of closed cells, when the blowing takes place in situ in closed shaping cavities. The foam is termed open celled already when the open cells amount to about 15–20% of the total cell mass and are distributed such that they form throughchains enabling a more or less sluggish auction or blowing through the material. In connection with the invention a material having at least some 30% open cells is preferred. It is worth noting that the conditions in the closed cells will be much different from those in foal consisting pronouncedly of closed cells, viz. In that all the closed cells will be located quite close to open cells, such that irrespectively of the material thickness there will be a short diffusion distance between the closed cells and the open system. In practice, therefore, it does not make any big difference whether the material is fully or only partly open celled, so the preferred polyurethane foams may very well still be used.

Normally it will not be necessary to use braces between the opposed panel walls, as a PUR foam, for example, may withstand the occurring compressive forces already by densities of 25–30 g/l, this being even less than a conventionally preferred minimum density. A practically usable density interval will be 25–30 g/l.

A representative measuring result for the heat conductivity as a function of the pressure in a specific foam is listed in the following table. The foam is ah aged PUR foam with density 34 g/l and with 39% open cells of average size 0.2–0.3 mm. P indicates the pressure and T the applied auction time.

| | | | | | | |
|---|---|---|---|---|---|---|
| P/mbar | 1000 | 25 | 2 | 1 | 0, 5 | 0.1 |
| mW/mk | 33 | 30 | 20–25 | 15–20 | 10–15 | <10 |
| T/hours | 0 | 0.5 | 3 | 15 | 50 | 75 |

The figures in the table are to be considered as tendency indicating rather than absolute, as more exact results would require a comprehensive description of measuring arrangement and methods. It is clear, however, that by the evacuation of the material usable results start to appear when the pressure decreases to below 25 mbar, while the results at both 2 and 1 mbar are very advantageous for practical use.

A still better result is achieved at 0.5 bar, but there is reason to consider whether such a further improvement is justified in practice by the associated higher demands as to tightness and pump effect as well as pumping time.

The heat conductivity is further reduced when foam of still smaller cell size is used, and the suction time is reduced for an increased content of open cells.

The surprising finding of the fact that it is possible by the discussed moderate vacuum, to achieve a marked reduction of the heat conductivity of usual commercial foam materials, is not per se connected with the use of open celled foam, i.e. In principle the invention will also comprise units with closed foam, whereby it will only be necessary to accept a much longer pumping time and somewhat less favourable results, because it will take time, currently, to pump out the internally developed gases.

The invention is not limited to the use of just foam as a core material, as also various fibre and powder materials exhibiting - fully open - pores of the relevant magnitude of size. As a well suited material group can be mentioned the so-called aerogels, which are already used in the hermetically closed systems.

It is possible to arrange in the construction insulating braces or ribs, e.g. of an open celled foam material of high density. The tightness of the surface say be achieved in different manners independent of an outer encapsulation, e.g. by a sheet coating or a surface treatment for the formation of a tight skin, though not necessarily diffusion tight. Moreover, the integral skin technique can be used, whereby there is automatically formed a tight surface layer against a forming surface.

I claim:

1. A thermally insulating unit comprising a cabinet having hollow walls defining an evacuatable space within which a core of cellular material is disposed, a vacuum pump communicating with said evacuatable space; wherein the cellular material has cells which are predominantly of a size in a range of about 0.5–0.1 mm; wherein said cabinet is constructed to permit a limited rate of air leakage into said evacuatable space; and wherein said vacuum pump has a pumping capacity which is coordinated to the limited rate of air leakage in a manner enabling said pump to maintain a pressure of a magnitude of 0.1–25 mbar within said evacuatable space.

2. A thermally insulating unit according to claim 1, wherein the cellular material is a blown plastic material having at least a 15–20% content of open cells and a density of 20–75 g/l.

3. A thermally insulating unit according to claim 2, wherein said cellular material is an in-situ blown foam with a density of about 35–60 g/l; and wherein said cabinet has a compartment within which said vacuum pump is mounted.

4. A thermally insulating unit according to claim 1, wherein the construction of the cabinet which permits the limited rate of air leakage is an air permeable portion of the cabinet wall.

5. A thermally insulating unit according to claim 4, wherein said vacuum pump is connected with said evacuatable space at a part of said cabinet which is located at a large enough spacing from said air permeable portion to create a limited cleansing flow through said evacuatable space.

6. A thermally insulating unit according to claim 4, wherein the air permeable area produced by a controllably openable and closable leak producing means.

7. A thermally insulating unit according to claim 4, wherein the air permeable area produced by one of an air permeable cabinet joint and an air permeable surface layer.

8. A thermally insulating unit according to claim 1, wherein said cabinet is a refrigerator cabinet.

9. A method of thermally insulating a cabinet having hollow walls defining an evacuatable space within which a core of cellular material, having cells which are predominantly of a size in a range of about 0.5–0.1 mm, is disposed, and a vacuum pump communicating with said evacuatable space comprising the steps of operating said vacuum pump so as to evacuate said evacuatable space and simultaneously producing a limited rate of air leakage into said evacuatable space, said limited rate of air leakage being coordinated to pumping capacity of the pump a manner enabling said pump to maintain a pressure of a magnitude of 0.1–25 mbar within said evacuatable space after an initial pump-down phase.

* * * * *